US005448941A

United States Patent [19]

Godfrey et al.

[11] Patent Number: 5,448,941

[45] Date of Patent: Sep. 12, 1995

[54] UNDERWATER DELIVERY SYSTEM

[75] Inventors: Daniel M. Godfrey, Portsmouth; Mark V. Chester, Tiverton, both of R.I.

[73] Assignee: The United States of America as represented by the Secretary of the Navy, Washington, D.C.

[21] Appl. No.: 174,925

[22] Filed: Dec. 29, 1993

[51] Int. Cl.[6] ..... F41F 3/10; B63G 8/32

[52] U.S. Cl. ..... 89/1.809; 114/238

[58] Field of Search ..... 89/1.809, 1.810, 1.815; 114/238, 239, 316

[56] References Cited

U.S. PATENT DOCUMENTS

| | | | |
|---|---|---|---|
| 815,393 | 3/1906 | Wheless | 114/239 |
| 925,707 | 6/1909 | Lake | 114/239 |
| 3,890,919 | 6/1975 | Opdahl et al. | 114/239 |
| 4,637,292 | 1/1987 | Peterson | 89/1.815 |
| 4,685,377 | 8/1987 | Mace et al. | 89/1.815 |

*Primary Examiner*—David Brown
*Attorney, Agent, or Firm*—Michael J. McGowan; Prithvi C. Lall; James M. Kasischke

[57] ABSTRACT

Apparatus for launching a device from a vessel includes a launcher having a pair of launch bay doors retractable within a launch bay, and first and second connection mechanisms for holding first and second ends of the device. The connection mechanisms extend the device partially out of the launch bay simultaneous with the retraction of the bay doors into the launch bay. The first connection mechanism releases the first end of the device while the second connection mechanism rotatably holds the second end of the device. This allows the device to rotate away from the launch bay until a preset position is reached at which point the second end of the device separates from the second connection mechanism allowing the device to move away from the launcher.

15 Claims, 7 Drawing Sheets

UNDERWATER DELIVERY SYSTEM

STATEMENT OF GOVERNMENT INTEREST

The present invention may be manufactured and used by or for the Government of the United States of America for governmental purposes without the payment of any royalties thereon or therefor.

BACKGROUND OF THE INVENTION (1) Field of the Invention

This invention relates generally to launch mechanisms and more particularly to underwater launch mechanisms.

(2) Description of the Prior Art

As is known in the art, there generally exist two categories of submarine launch mechanisms. A first category includes those launchers which are internally mounted in a ship. A second category include those launchers which are mounted external to the hull of a ship.

Conventional internally mounted underwater launch systems generally include tube launchers that use a containment tube disposed inside a submarine or a ship. Such underwater launch mechanisms incorporate environmentally sealing, remotely operated muzzle and breech end doors, flooding and drainage systems, and a launch impetus system to expel a device from the launching system.

Internally mounted launchers can be reloaded at sea using devices stored inside the submarine or surface ship. These launchers are generally relatively large, complicated and heavy, and require several minutes to reload. A submarine based system places large demands on the ship's available space and ballast since all launcher equipment, loading and handling equipment and devices are located inside the submarine and are typically concentrated in one magazine area. Furthermore such internally mounted launchers typically generate a relatively large noise signature during launch.

External submarine launchers can be mounted on a stabilizer support, a rudder support, or the sail of a submarine. External type launchers generally incorporate a containment tube to stow and protect the device prior to launch. Such external launchers may require a launch impetus system to expel the devices, and may incorporate environmentally sealed doors to protect the devices prior to launch.

The size and number of devices such external launchers can carry is severely limited by their mounting location. These launchers are generally not reloaded at sea. The noise signature generated by such externally mounted launch systems during launch varies depending on the type of launch impetus used, if any.

It would, therefor be desirable to provide a relatively compact launch system which can be internally or externally mounted on a ship. Furthermore in some applications, such as military applications for example, it is desirable to provide such a compact launch system having a relatively quiet noise signature upon launching of a device.

SUMMARY OF THE INVENTION

Accordingly, it is a general purpose and object of the present invention to provide a compact launch system for launching underwater vehicles, countermeasures, or other devices.

It is a further object that such launch system be reliable, and therefore mechanically simple.

Another object is that the launch system have a relatively low acoustic signature during launch.

Accordingly, the present invention provides a launcher for launching devices from a vessel which includes front and rear connectors coupled to movable collets which travel in tracks disposed perpendicular to the vessel's hull surface. With this arrangement a relatively compact launching system having a relatively quiet noise signature is provided. The launching system can be used to launch devices including but not limited to underwater vehicles, torpedoes, encapsulated missiles, mines, and countermeasure devices having a substantially cylindrical cross section. The length to diameter ratio of such devices is typically be greater than five. The launcher system utilizes the weight or buoyancy of the device to separate the device from the host vessel. The launcher can be disposed on the vessel such that the device can be launched from a bottom surface of the vessel. Thus, in such applications the device should be negatively buoyant. Alternatively, the launcher can be disposed on the vessel such that the device can be launched from a top surface of the vessel such as the top surface of a submarine for example. In such applications, the device should be positively buoyant. Thus, to ensure a safe launch trajectory, the device can be either negatively buoyant and launched from the bottom of a surface vessel or submarine, or positively buoyant and launched from the top of a submarine. The device is stored in a free flooding (not environmentally sealed) launch bay having a longitudinal axis parallel to a longitudinal access of the host ship. Each device is stored in a dedicated launch bay having opening doors and a launch mechanism. Thus the launcher cannot ordinarily be reloaded at sea. The launcher can be installed external or internal to the ship's external hull. When the launcher is externally mounted, the launcher can have a shape selected to present a minimum frontal area to reduce hydrodynamic drag and flow noise generated by such external installations. When the launcher is internally mounted, however, the launcher requires a minimum of interior space. A compact and quiet launcher is especially advantageous in military applications to maximize efficient use of space while minimizing the impact on the vessel's operating envelope and radiated noise.

BRIEF DESCRIPTION OF THE DRAWINGS

The foregoing features of this invention as well as the invention itself may be more fully understood from the following detailed description of the drawings in which.

DESCRIPTION OF THE PREFERRED EMBODIMENTS

Throughout the several drawings, like elements are provided having like reference designations.

Figure 1:
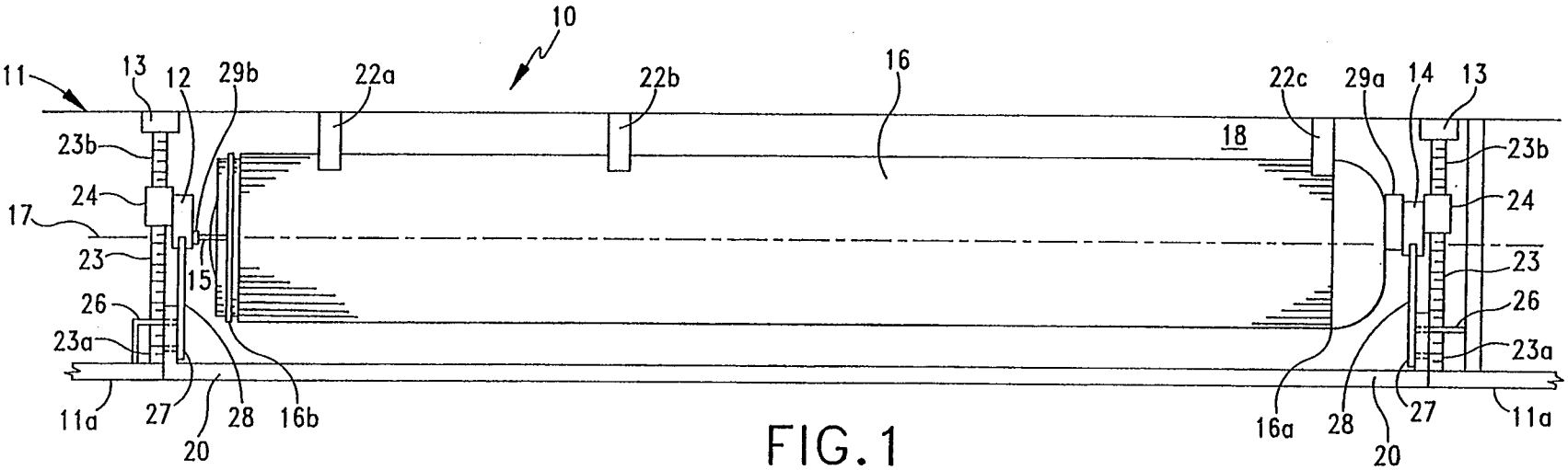
FIG. 1 is a side view of the launch system of the current invention with the bay doors closed.

Referring now to FIG. 1, an underwater delivery system or launcher 10, is shown disposed in a portion of a vessel 11. The vessel 11 may be provided as a surface ship or a submarine for example. The launcher 10 includes first and second connection mechanisms 14, 12 coupled to first and second ends 16*a*, 16*b* of a device 16 to be launched from a launch bay 18.

First and second connection mechanisms 12 and 14 are disposed on collets 24. As collets 24 are lowered along drive screws 23, actuator arms 28 open bay doors 20*a*, 20*b* (FIG. 1A) generally denoted by 20, device 16 is simultaneously lowered from launch bay 18. Drive screws 23 are coupled on one end to vessel 11 using any conventional technique. Drive mechanisms 13 are coupled to drive screws 23 and are provided for turning the screws 23 in first and second opposite directions.

Figure 1C:
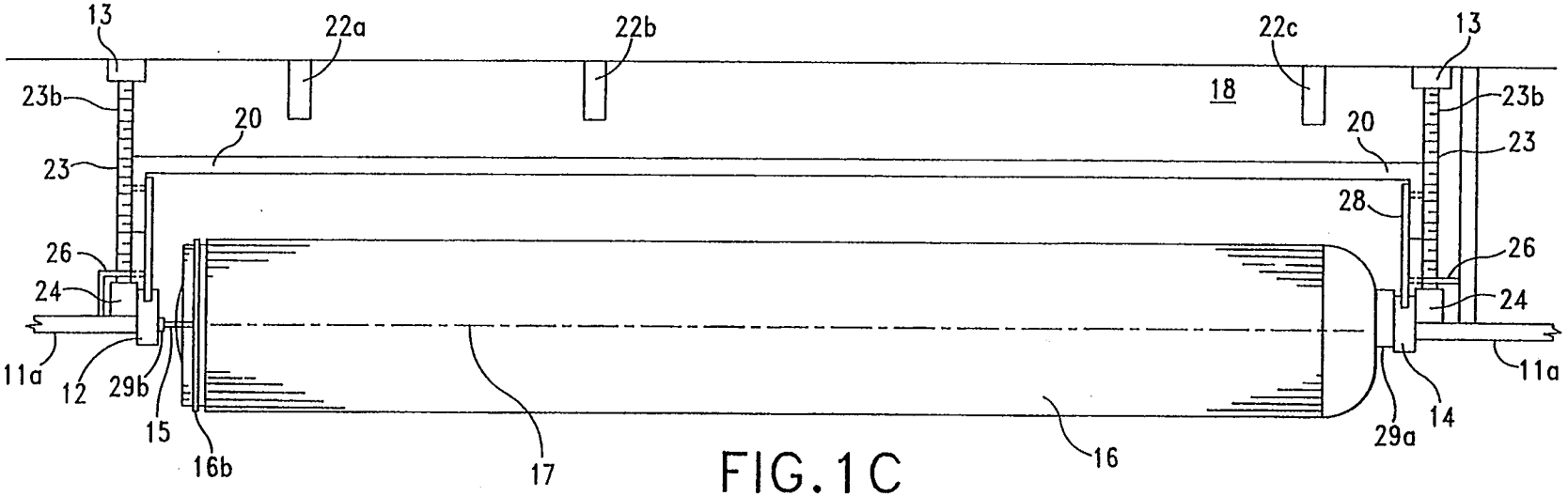
FIG. 1C is a side view of the launch system of the current invention with the bay doors opened.

Connection mechanism 14 includes a first latch 29*a* disposed on collet 24 and coupled to end 16*a* of device 16. In the preferred embodiment, connection mechanism 12 includes a pin 15 having a first end thereof rotatably coupled to a pivoting latch 29*b*. A second end of pin 15 is removably coupled to end 16*b* of device 16. See FIG. 1D.

In FIG. 1, device 16 is shown secured in the stowed position of launch bay 18 with a pair of launch bay doors 20*a*, 20*b*, (FIG. 1A) generally denoted 20, in a closed position. In the stowed position, supporting chocks 22*a*–22*c* are disposed to support device 16 to allow device 16 to withstand shock loading due to high impact forces.

Figure 1A:
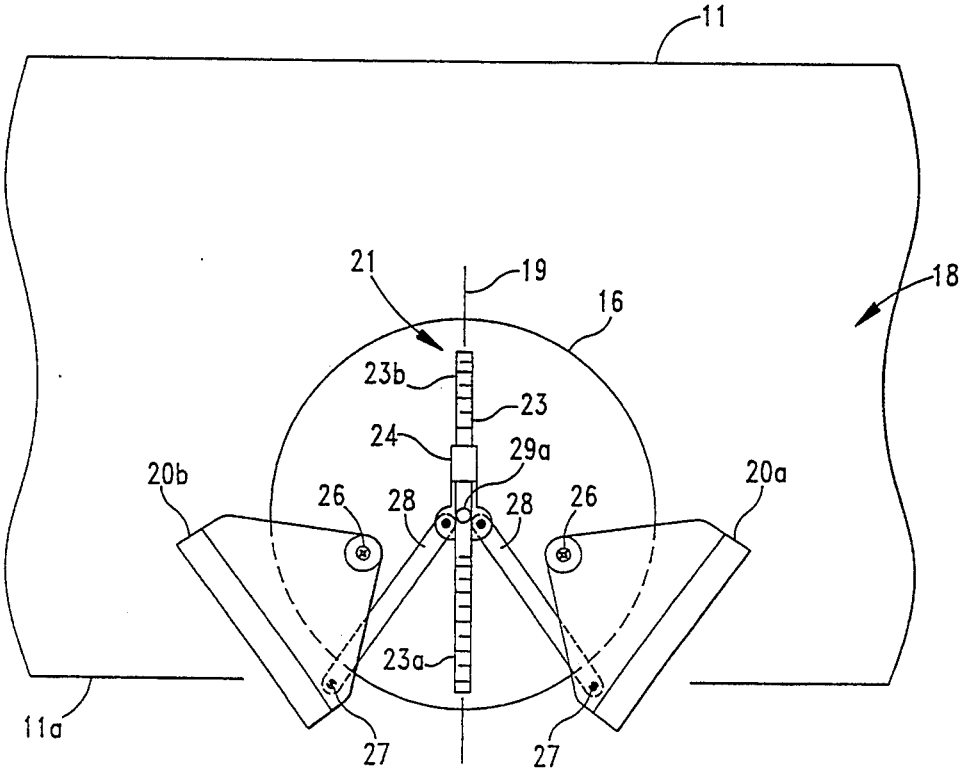
FIG. 1A is an end view of the launch system of the current invention employing a drive screw.

Referring now to FIG. 1A, there is shown an end view of the inventive device with doors 20*a*, and 20*b* partially open. Doors 20*a*, 20*b*, are coupled to moveable collet 24 through actuator arms 28. Collet 24 can travel in optional tracks (not shown) which define and confine the motion of collet 24. Such tracks can, for example, be located along a centerline 19 of launch bay 18 at front and rear ends of launch bay 18. Collets 24 are moved via a drive mechanism here provided as drive screw 23 about which collet 24 is disposed.

Drive screw 23 can rotate in both clockwise and counterclockwise directions. In response to the drive screw 23 rotating in a first direction, collet 24 moves to the external end 23*a* of the drive screw 23. In response to the drive screw 23 rotating in a second direction, the collet 24 moves to the internal end 23*b* of the drive screw 23.

A first end of each actuator arm 28 is rotatably coupled to collet 24 and a second end of each actuator arm is rotatably coupled to one of the bay doors 20*a*, 20*b* at connection point 27. Bay doors 20*a*, 20*b* rotate on hinge pins 26 located inside launch bay 18 such that doors 20*a*, 20*b* rotate and retract inside launch bay 18 when doors 20*a*, 20*b*, are opened. As mentioned above, when collet 24 is lowered along drive screw 23, actuator arms 28 open bay doors 20*a*, 20*b* and device 16 is simultaneously lowered from launch bay 18. Thus, drive screw 23, collet 24 and actuator arms 28 together provide a door actuating launch mechanism 21.

Figure 1B:
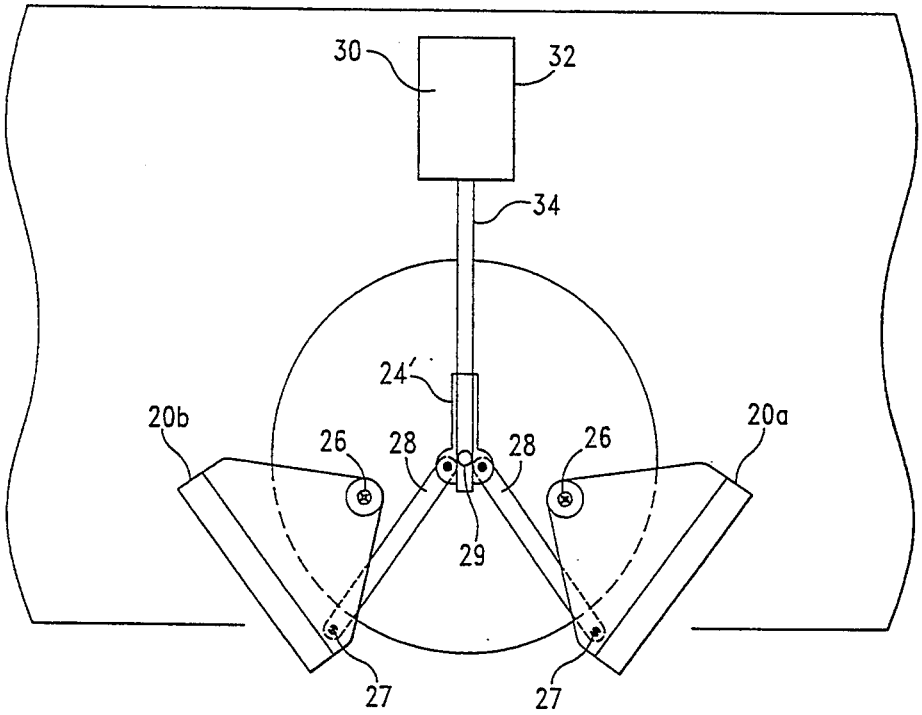
FIG 1B is an end view of the launch system of the current invention employing a fluidic actuator.
Figure 1D:
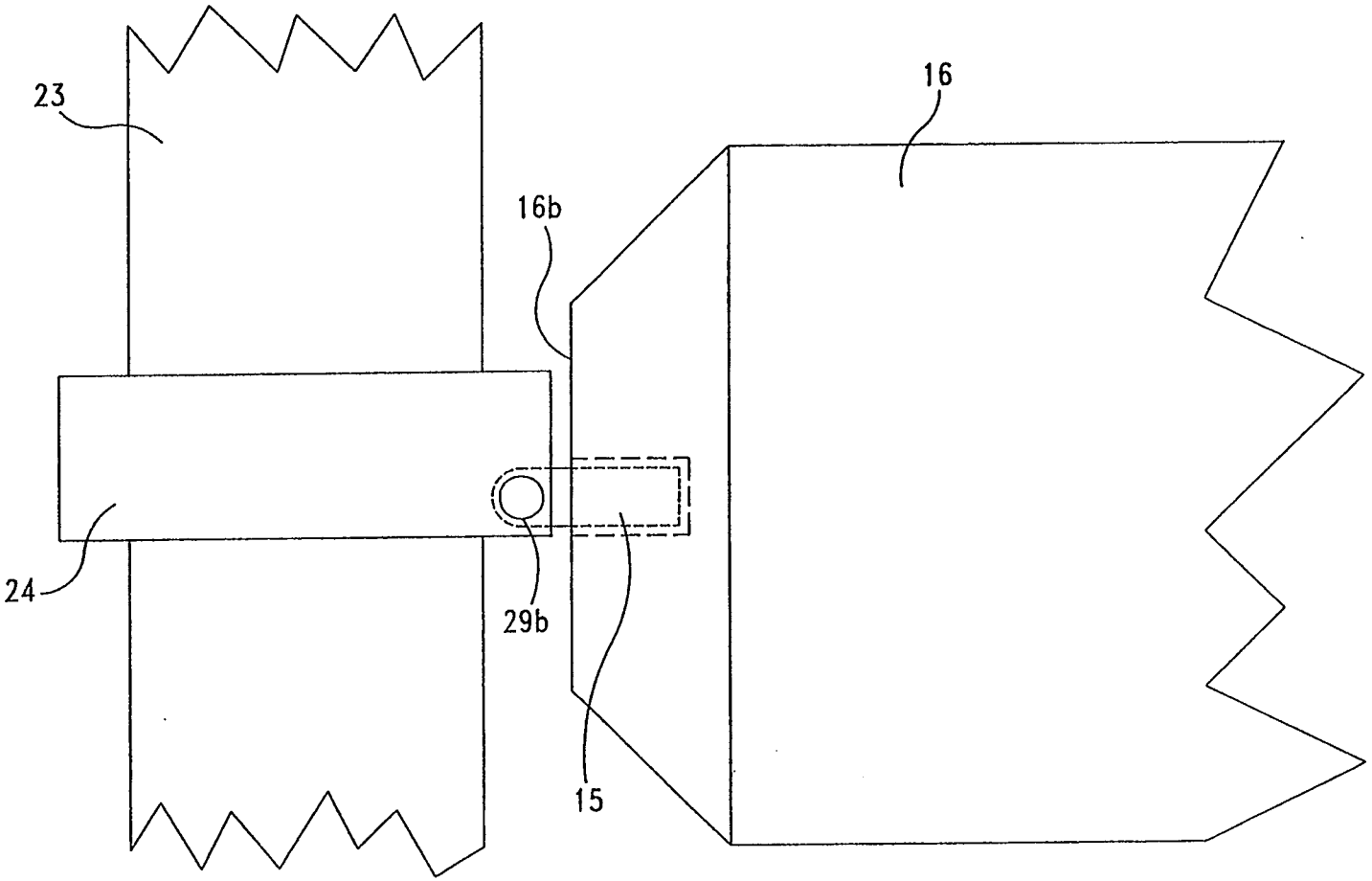
FIG. 1D is a detail view of the second connection mechanism of the inventive device.

Referring briefly to FIG 1B, there is shown an alternate embodiment of the inventive device employing a fluidic actuator 30 in place of drive screw 23 and collet 24. A fixed end 32 of actuator 30 is coupled to the inner surface of launch bay 18. A moveable rod 34 of actuator 30 extends toward bay doors 20*a* and 20*b*. Moveable rod 34 has a terminator 24' coupled thereto. Actuator arms 28 and connection mechanisms 12 and 14 (FIG. 1) are coupled to terminator 24' and in response to movements of rod 34 bay doors 20*a* and 20*b* open while lowering device 16. Those of ordinary skill in the art will recognize, of course, that other mechanisms can also be used to lower device 16 and open launch bay doors 20.

Referring again to FIG. 1A, in this particular embodiment, bay doors 20*a*, 20*b* are each provided having a width greater than one half the diameter of the device 16 to thus ensure clearance is provided while the doors 20 are opened and to ensure complete closure when the doors 20 are closed. Furthermore, the bay doors 20*a*, 20*b* have a length selected to be longer than the device 16 to allow clearance for actuating launch mechanism 21. It is recognized, of course, that doors 20*a*, 20*b* can have any length and width selected to expose an opening in launcher 18 through which device 16 can be launched. Moreover, in some applications it may be desirable to provide the doors 20*a*, 20*b* having widths and lengths which are not equal.

Referring now to FIG. 1C, device 16 is coupled to collets 24 via connection mechanisms 12 and 14 which, as mentioned above, are here provided from pin 15, and latches 29*a*, 29*b*. Thus, when bay doors 20 are in the fully open position, a centerline 17 of device 16 is located beyond the outer surface 11*a* of vessel 11 and of launcher 18.

Positioning device 16 prior to release such that the mid point 17 of device 16 is beyond all launcher/vessel structures prevents interference between device 16 and launcher/vessel during launch. Furthermore, retraction of doors 20*a*, 20*b* into the cavity in which the device 16 is stored minimizes the possibility of interference occurring between device 16 and doors 20*a*, 20*b*.

Doors 20*a*, 20*b* need not provide a watertight seal and need not be pressure hardened. Thus the complexity of doors 20*a*, 20*b* and door actuating/launch mechanism 21 is minimized.

Figure 2:
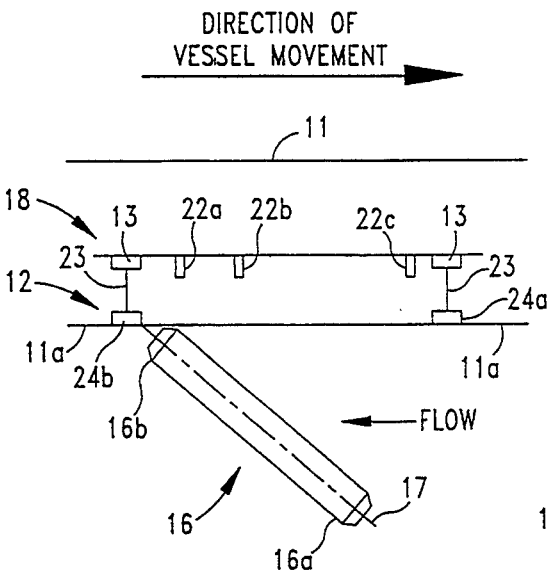
FIGS. 2 and 2A are a series of views showing a device being launched using the launch system of FIG. 1.

Referring now to FIG. 2, when collet 24*a* at the forward end 16*a* of device 16 reaches the end of its stroke, latch 29*a* (FIG. 1) is actuated to release the first end 16*a* of the device 16. Gravity (or buoyancy) then causes the first end 16*a* of device 16 to rotate down (or up), while the second end 16*b* of the device 16 is still attached to second collet 24*b* at the rearward end 16*b* of device 16.

As device 16 rotates into a flow field caused by movement of the vessel's hull 11 through the water, hydrodynamic drag causes first end 16*a* of the device 16 to accelerate rapidly away from the host vessel. When device 16 rotates to a predetermined position, here corresponding to a position wherein the central longitudinal axis 17 of device 16 is approximately perpendicular to surface 11*a* of vessel 11, the weight (or buoyancy) of device 16 separates pin 15 from device 16 at end 16*b*, allowing device 16 to drop (or rise) safely away from vessel 11. After launch, collets 24 are retracted into launch bay 18 thus closing bay doors 20.

Quiet operation is thus achieved by using gravity or buoyancy as the launch impetus. Quietness of operation can be further enhanced by providing drive mechanism 13 as a low speed drive mechanism for actuating launch mechanism 21.

The amount of transient noise provided by launcher 10 during the launch cycle can be reduced by controlling the acceleration rate of the drive mechanism upon start up and the deceleration upon stopping. Furthermore by providing launcher system 10 with doors 20*a*, 20*b* which retract into the launch cavity when open and cover at least a portion of the launch cavity when closed, flow noise before and during launch is minimized.

By providing a single mechanism for both door activation and device deployment, launcher 10 allows device deployment from a reliable and simple mechanism. Furthermore, full launch system redundancy is aided by providing a plurality of separate launch systems 10 for a corresponding plurality of devices 16. This approach eliminates internal weapons handling that is required if one launch mechanism is used for several devices and also reduces overall system complexity.

If the device 16 is provided as a neutrally buoyant device, then a separating force can be used to launch a device by employing a force other than gravity (or buoyancy) to separate device 16 from vessel 11. Such a separating force can be provided, for example, by springs, a drogue parachute or an electromagnetic induced force.

Figure 4A:
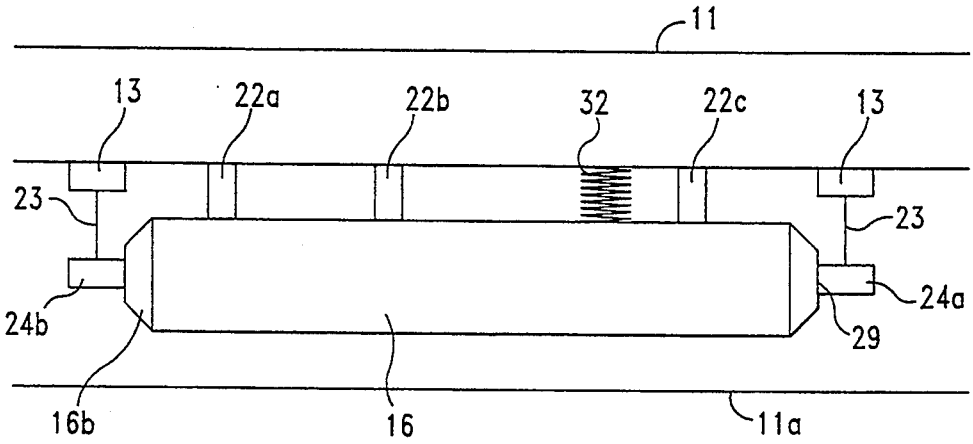
FIGS. 4A and 4B show use of a spring induced separation force in a launch system of the current invention.
Figure 4B:
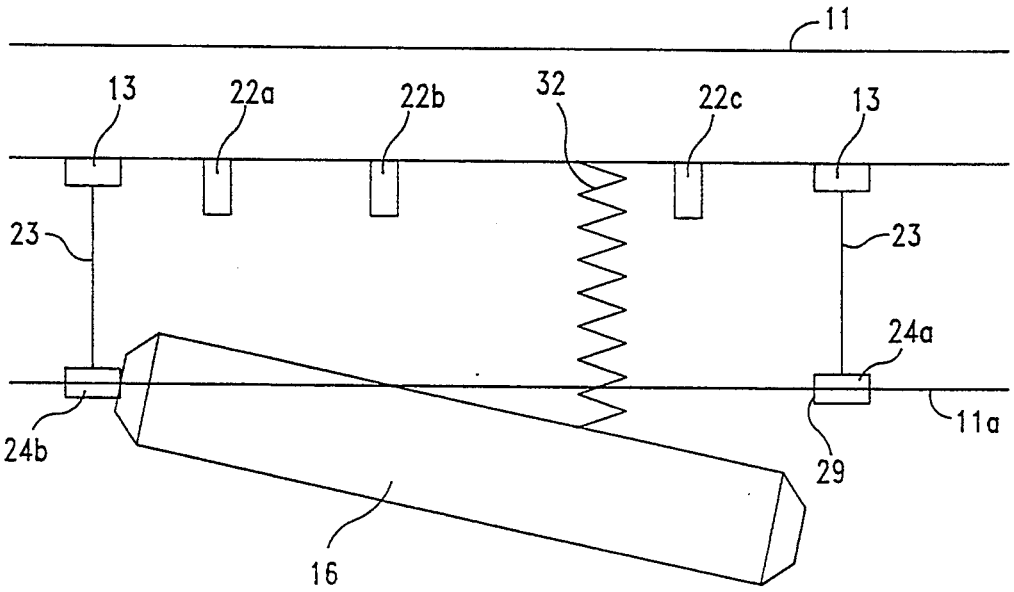
Figure 5A:
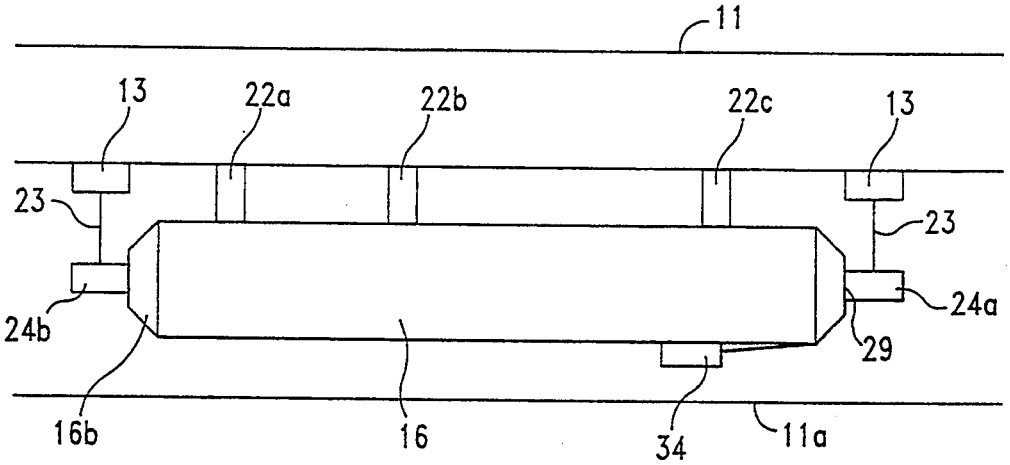
FIGS. 5A and 5B show use of a drogue parachute to provide a separation force in a launch system of the current invention.
Figure 5B:
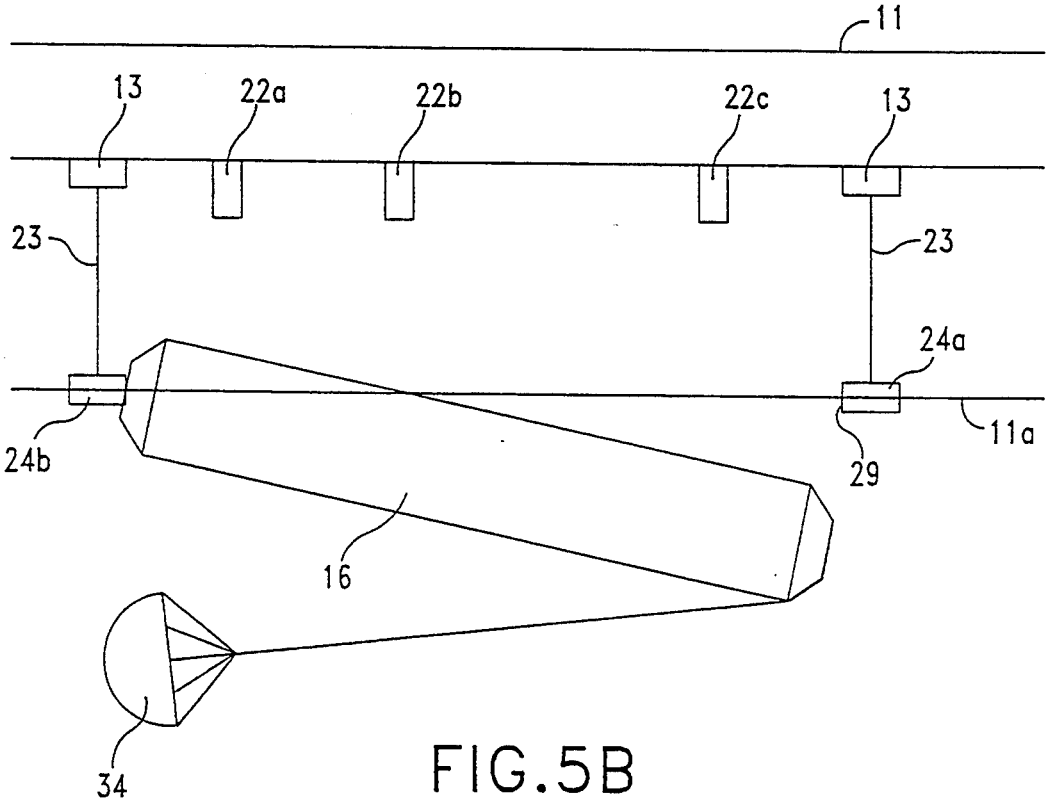
Figure 6A:
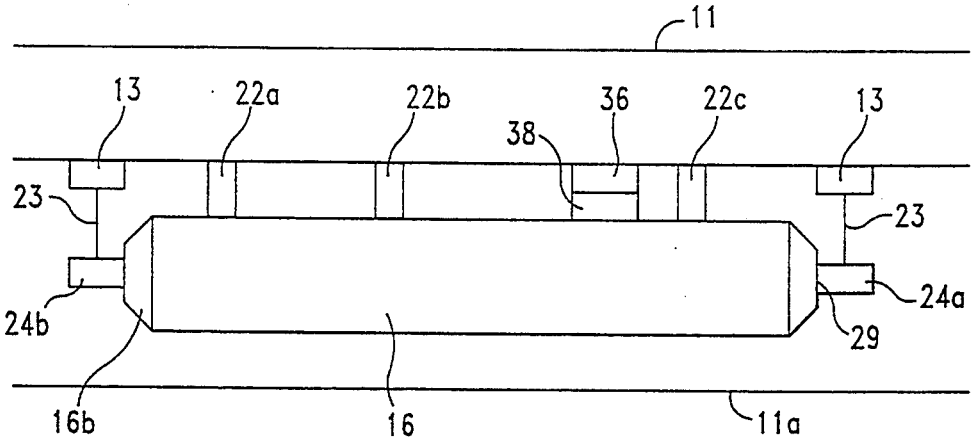
FIGS. 6A and 6B show use of an electromagnetic force to provide a separation force in a launch system of the current invention.
Figure 6B:
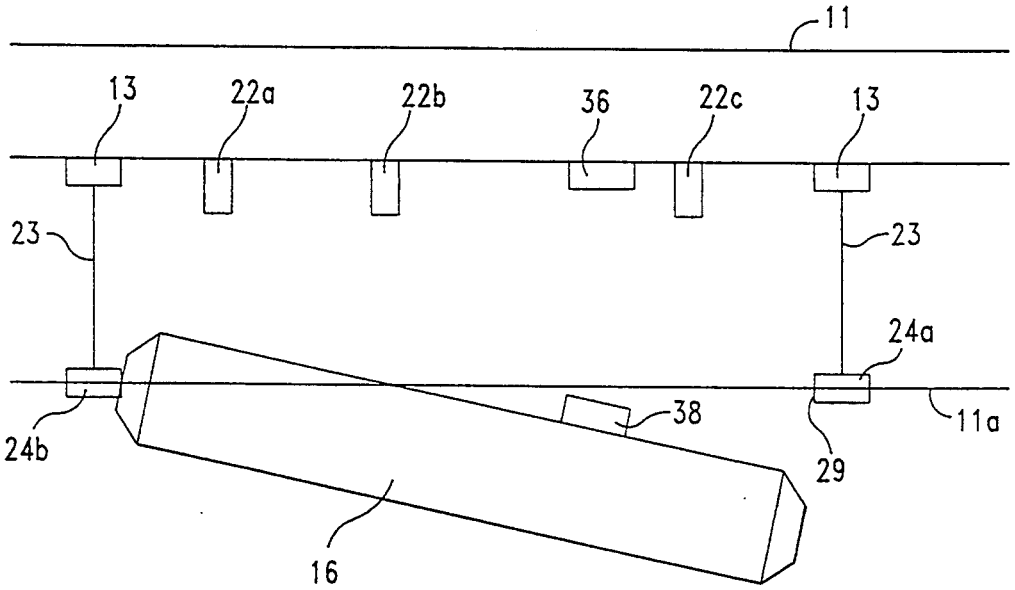

FIG. 4A shows a spring 32 mounted between vessel 11 and device 16. Upon release of latch 29, spring 32 uncoils as shown in FIG. 4B to provide a separating force in absence of an external force. FIG. 5A shows a drogue parachute 34 joined to the forward part of device 16 to provide a separating force. In FIG. 5B drogue parachute 34 is shown deployed to allow hydrodynamic forces to separate device 16 from vessel 11. FIG. 6A shows an electromagnet 36 and a magnet 38 deployed on vessel 11 and device 16 respectively. Upon extension of launch mechanism, FIG. 6B shows activation of electromagnet 36 to provide a electromagnetically induced repulsive force between vessel 11 and device 16.

Figure 3:
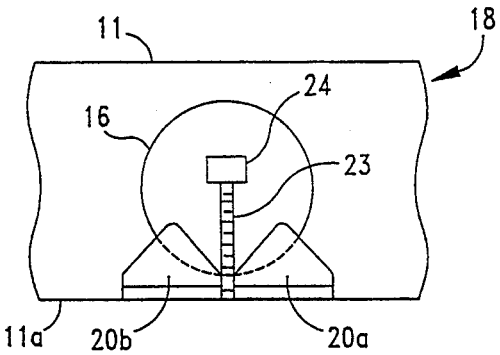
FIGS. 3–3C are a series of end views showing the steps in a launch process.
Figure 3A:
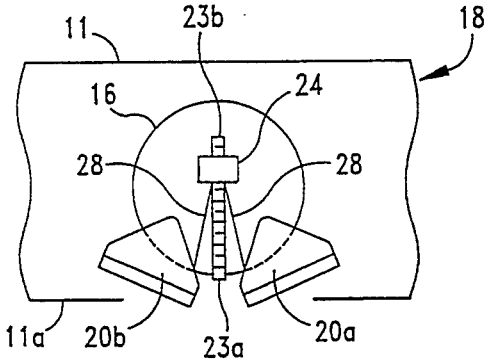
Figure 3B:
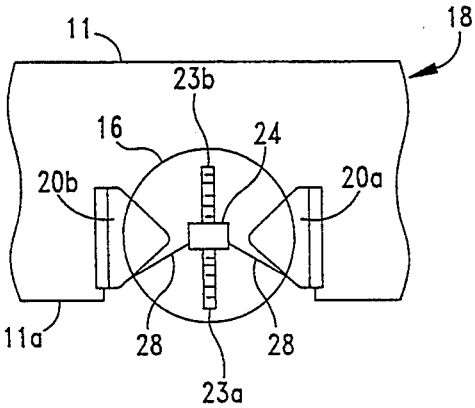
Figure 3C:
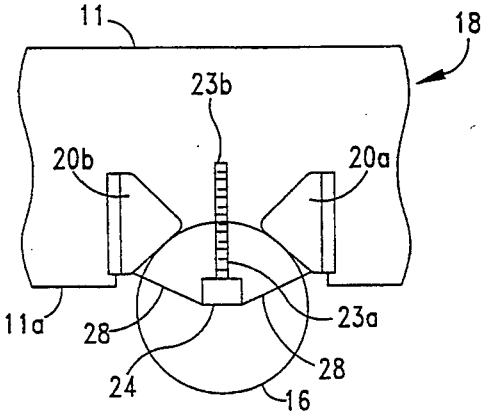

As shown in FIGS. 3–3C, in operation device 16 is lowered out of the launch bay 18 simultaneous with the opening of the bay doors 20*a*, 20*b*. In FIG. 3 device 16 is shown in the stowed position with bay doors 20*a*, 20*b* closed. Thus, collet 24 is positioned at the end 23*b* of drive screw 23. (See FIGS. 3A–3C).

Referring now to FIG. 3A, collet 24 has moved along drive screw 23 a predetermined distance and consequently actuator arms 28 have moved a corresponding distance to provide an opening between doors 20*a*, 20*b*. Furthermore, device 16 has simultaneously been lowered a distance corresponding to the distance which collet 24 has moved. It should be noted that the opening between doors 20*a*, 20*b* is of sufficient distance to ensure that no interference between device 16 and doors 20*a*, 20*b* occurs.

Referring now to FIG. 3B, collet 24 has moved further along screw 23 resulting in corresponding movements of actuator arms 28, doors 20*a*, 20*b* and device 16 as shown. It should be noted that movements of device 16 occur simultaneously with movements of doors 20*a*, 20*b*.

Figure 2A:
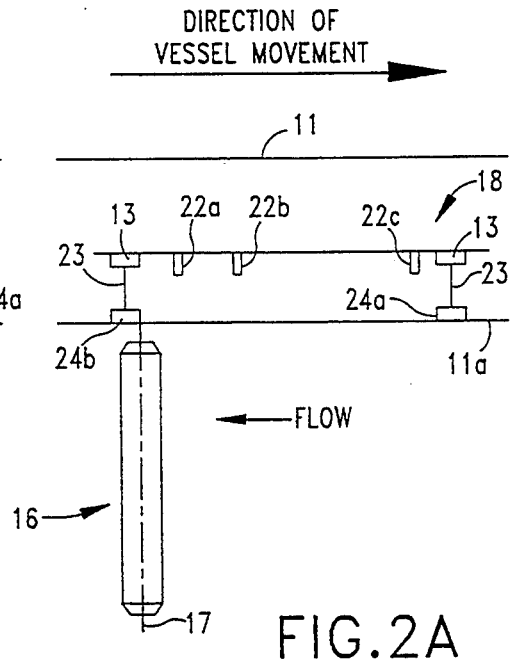

Referring now to FIG. 3C, collet 24 has reached end 23*a* of screw 23. Consequently, doors 20*a*, 20*b* are fully open and are retracted within the launch cavity. The center line of device 16 is beyond outer surface wall 11*a* and thus is disposed in the flow field of the vessel as described above in conjunction with FIGS. 2 and 2A.

Having described preferred embodiments of the invention, it will now become apparent to one of skill in the art that other embodiments incorporating the concepts can be used. It is felt, therefore, that these embodiments should not be limited to disclosed embodiments but rather should be limited only by the spirit and scope of the appended claims.

What is claimed is:

1. A launch system for launching a device from a craft comprising:

a first connection mechanism detachably joined to a first end of said device;

a second connection mechanism comprising a pivoting latch allowing rotation of said device upon release of said first end of said device, and a pin having an axis disposed on said pivoting latch and detachably joined to said second end of said device to provide vertical and horizontal support, said pin joined to said device slideably in the axial direction and thereby releasing said device when said pivoting latch rotates to said preset position in response to a separation force on said connected device;

at least one launch mechanism coupled to said first connection mechanism and said second connection mechanism to move said first and second connection mechanisms away from said craft for launch of said device, said first connection mechanism detaching from said first end of said device when said device has been moved away from said craft;

a launch bay joined to said craft;

a pair of launch bay doors joined pivotally to said launch bay having a predetermined width and a predetermined length allowing each of said launch doors to retract within said launch bay when opened; and at least one door actuating link coupling at least one said connection mechanism to each said launch bay door to open said launch bay door on movement of said connection mechanism away from said craft.

2. The launch system of claim 1 wherein said launch mechanism comprises:

a drive mechanism joined to said launch bay;

a drive screw having first and second ends, said first end being joined to said drive mechanism to allow said drive mechanism to rotate said drive screw;

a collet disposed about said drive screw to move along the length of said drive screw when said drive screw is rotated; and at least one door actuating link having a first end coupled to said collet and having a second end coupled to at least one of said launch bay doors to open said door upon movement of said collet to said second end of said drive screw;

said first connection mechanism releasing said first end of said device when said collet is moved to said second end of said drive screw.

3. The launch system of claim 2 wherein said first connection mechanism is provided with a first launch mechanism and said second connection mechanism is provided with a second launch mechanism.

4. The launch system of claim 3 wherein said separation force is gravity.

5. The launch system of claim 3 wherein said separation force is buoyancy.

6. The launch system of claim 3 further comprising a spring joined to the interior of said launch bay and biased against said device, said spring providing said separation force upon release of said first connection mechanism.

7. The launch system of claim 3 further comprising a drogue parachute joined to said device and positioned on the side of said device facing said launch bay doors, said drogue parachute interacting with the flow field about said craft to provide said separation force.

8. The launch system of claim 3 further comprising:

an electromagnet positioned in said launch bay; and a magnet positioned on said device proximate said electromagnet to cause said separation force to be applied to said device on activation of said electromagnet.

9. The launch system of claim 1 wherein said launch mechanism comprises:

a fluidic actuator joined to said launch bay;

a moveable rod having first and second ends, said first end being joined to said fluidic actuator to allow said fluidic actuator to extend said rod;

a terminator disposed on said second end of said moveable rod to extend with said rod; and at least one door actuating link having a first end coupled to said terminator and having a second end coupled to at least one of said launch bay doors to open said door upon extension of said moveable rod;

said first connection mechanism releasing said first end of said device when said moveable rod is fully extended.

10. The launch system of claim 9 wherein said first connection mechanism is provided with a first launch mechanism and said second connection mechanism is provided with a second launch mechanism.

11. The launch system of claim 10 wherein said separation force is gravity.

12. The launch system of claim 10 wherein said separation force is buoyancy.

13. The launch system of claim 10 further comprising a spring joined to the interior of said launch bay and biased against said device, said spring providing said separation force upon release of said first connection mechanism.

14. The launch system of claim 10 further comprising a drogue parachute joined to said device and positioned on the side of said device facing said launch bay doors, said drogue parachute interacting with the flow field about said craft to provide said separation force.

15. The launch system of claim 10 further comprising:

an electromagnet positioned in said launch bay; and a magnet positioned on said device proximate said electromagnet to cause said separation force to be applied to said device on activation of said electromagnet.

* * * * *